US006038891A

United States Patent [19]

Zeren et al.

[11] Patent Number: 6,038,891

[45] **Date of Patent: *Mar. 21, 2000**

[54] SECURITY HOLE FASTENING DEVICE

[75] Inventors: Greg Zeren, Redwood City; Jay S. Derman, Redondo Beach, both of Calif.

[73] Assignee: ACCO Brands, Inc., Lincolnshire, Ill.

[ * ] Notice: This patent is subject to a terminal disclaimer.

[21] Appl. No.: 09/048,874

[22] Filed: Mar. 26, 1998

Related U.S. Application Data

[63] Continuation-in-part of application No. 08/825,213, Mar. 27, 1997, Pat. No. 5,787,739.

[51] Int. Cl.[7] ..... E05B 69/00

[52] U.S. Cl. ..... 70/58; 70/14; 70/158

[58] Field of Search ..... 70/14, 18, 58, 70/63, 423, 424, 426, 428, 430, 158

[56] References Cited

U.S. PATENT DOCUMENTS

| | | | |
|---|---|---|---|
| 5,327,752 | 7/1994 | Myers et al. | 70/57 |
| 5,381,685 | 1/1995 | Carl et al. | 70/58 |
| 5,493,878 | 2/1996 | Murray, Jr. et al. | 70/58 |
| 5,502,989 | 4/1996 | Murray, Jr. et al. | 70/58 |
| 5,687,592 | 11/1997 | Penniman et al. | 70/14 |
| 5,722,268 | 3/1998 | Choi | 70/57 |
| 5,787,739 | 8/1998 | Derman | 70/58 |
| 5,791,171 | 8/1998 | Kelley | 70/58 |

*Primary Examiner*—Teri Pham

*Attorney, Agent, or Firm*—Townsend and Townsend and Crew LLP

[57] ABSTRACT

A device and method for fastening to equipment subject to theft and provided with a security slot. The device is inserted in the security slot located in the shell of the equipment. The device includes of two similarly-shaped plates having a hooked tang protruding from one edge. The plate tangs are inserted through the security hole so that the hooks grip the hole edges and the plates are wedged in back-to-back. The device further includes a locking mechanism such as a tab defining an aperture, through which a cable or lock is passed to hold the plates together in place. The device may include a saddle to cover the plates, or may include one plate bearing a locking member to rotatably engage the equipment to secure it against theft.

18 Claims, 5 Drawing Sheets

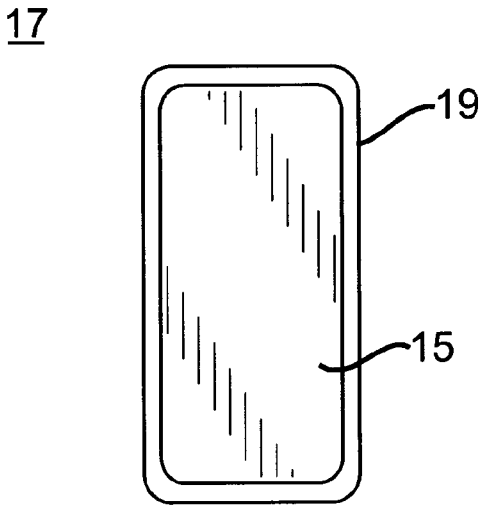
FIG. 11A
FIG. 11B
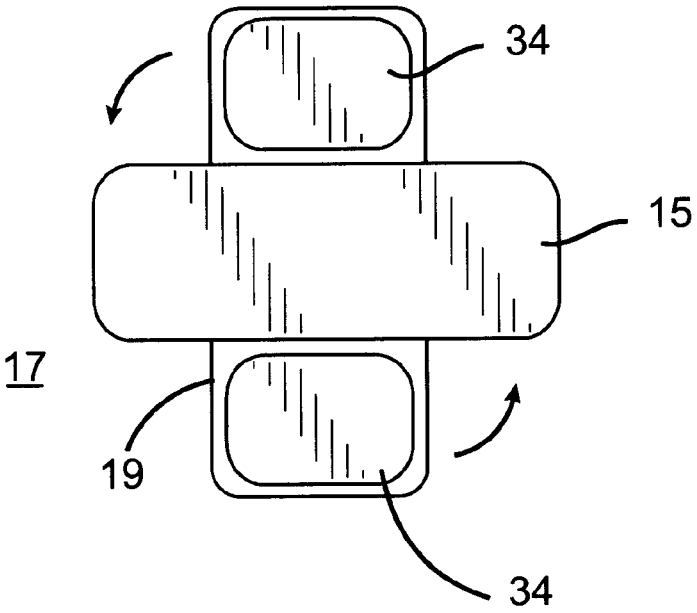

SECURITY HOLE FASTENING DEVICE

CROSS-REFERENCE TO RELATED APPLICATION

This application is a Continuation-In-Part of prior application Ser. No. 08/825,213, field Mar. 27, 1997, now U.S. Pat. No. 5,787,739.

BACKGROUND OF THE INVENTION

The present invention relates to preventing theft of electronic equipment. More particularly, the present invention provides a device and method by which equipment is fastened to a locking mechanism.

There presently exists a number of devices and methods for preventing theft of equipment such as portable laptop computers and hand-held electronic devices. Typically, these methods include a fastening block which is either adhered to or screwed to an equipment's outer shell or casing. A wire cable or metal chain is then attached to the fastening block and the ends of the cable or chain are looped around a suitable immovable object and locked in place. This prevents the equipment from being removed by unauthorized persons. U.S. Pat. No. 5,351,507 of Jay S. Derman entitled "Wire Cable Locking Device" describes one such approach which is found to be successful.

In order to standardize the available methods of fastening securing devices to equipment, industry has incorporated security holes or slots in the outer shell of certain equipments. Conventional security slots are either rectangular or rounded in shape. A rounded hole that is circular permits a fastener to rotate in the hole 360 degrees, which could be advantageous for some equipment and easier to construct. Most security slots also incorporate the inside surface of the equipments outer shell, to which a device could engage in a locking mode.

It is intended that the securing method utilize a fastener that can be inserted in the security slot provided in the equipment and thereby secure the equipment to a cable or padlock.

For the user's convenience, and for that of the equipment manufacturer, the fastener device should be able to stay attached to the equipment once it is inserted in the security hole, and not require an externally applied means such as a lock or cable to hold it in place. Loose fasteners may easily fall out of equipment security holes during attachment of a group of equipments to a cable, causing unnecessary bother. The same thing may occur when one or more equipments are removed from a securing cable for any reason, such as during a sale. It is, therefore, highly desirable to have a security hole fastener that will stay in place once inserted, and will take particular effort to be removed.

There are presently many known fasteners used for fastening to a piece of equipment, such as a door. Most of these fasteners use swivelling or pivoting arms that must be held in place by an external lock. These fasteners suffer from being susceptible to loosening and possibly falling out of the equipment security hole because of their size and construction. Further, none are adapted specifically for use with modern portable electronic equipment bearing standardized security slots.

It is therefore an object of the present invention to provide an inexpensive and reliable fastening device to prevent theft of portable equipment. It is a further object of the present invention to utilize a design which economizes the materials used in construction of the device, but which provides a high threshold of security. An even further object is to provide a device that, once fastened to an equipment shell, may not be pulled out or loosened.

SUMMARY OF THE INVENTION

The present invention provides a device and method for fastening to an equipment subject to theft and provided with a security slot. One embodiment of the present invention provides two insert plates, each having a projecting, hooked tang, and which are designed to hook, back-to-back, into an equipment security slot. In this position a distal end of each hooked tang extends oppositely from the other and bears against the inside surface of the shell. Each plate further includes an attachment mechanism to maintain the plates in their back-to-back locking mode.

A tab of the insert plates defines an aperture, which provides a mechanism for attaching the fastening device to a securing cable or lock. Thus, the fastening device is held at all times against the equipment surface and cannot loosen or be pulled out without careful disassembly.

In a second embodiment of the present invention, there is provided two insert plates as above, and a saddle adapted for sliding over the insert plates. The saddle has two parallel flaps sized to cover the insert plates in their back-to-back locking mode. Each flap of the saddle includes an attachment mechanism complementary to that of the insert plates.

In a third embodiment of the present invention, there is provided an insert plate and an overlaying saddle. The insert plate has a projecting tang and a locking member connected to the tang. The locking member is insertable into and removable from the security slot when the device is in an unlocked mode, and may be transitioned to bear against the inside surface of the equipment outer shell when the device is in a locked mode. The saddle has at least one projecting pin that is inserted into the security hole when the saddle is placed over the aperture insert plate, inhibiting transition of the device from its locked mode to the unlocked mode.

A further understanding of the nature and advantages of the present invention may be realized by reference to the latter portions of the specification and attached drawings

BRIEF DESCRIPTION OF THE DRAWINGS

FIG. 11A is a bottom view of the locking member of the third or fourth embodiment being inserted into a security slot; and FIG. 11B is a bottom view of the locking member engaging an inside surface of an equipment shell and being locked by pins attached to a saddle of the third or fourth embodiment.

DESCRIPTION OF THE PREFERRED EMBODIMENT

Figure 1:
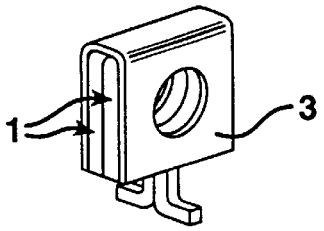
FIG. 1 is a perspective view of a first embodiment of an assembled fastening device.

Referring particularly to the drawings, there is shown in FIG. 1 a perspective view of a first embodiment of an assembled device according to the present invention. The device consists of two similar insert plates 1 covered by a saddle 3. Protruding out beneath both the insert plates 1 and the saddle 3 are hooked tangs 7 of the insert plates 1.

Figure 2:
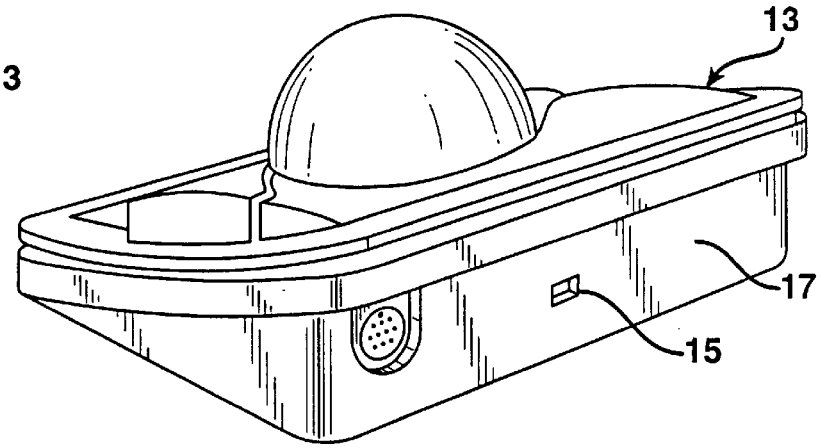
FIG. 2 is perspective view of an example equipment, particularly showing its shell defining a security slot.

Refer now to FIG. 2 which illustrates a typical computer equipment accessory 13, having a security slot 19 in its shell 17. Equipment 13 is shown as a computer peripheral device for example purposes only and should not limit the scope of the claims herein. One of ordinary skill in the art would recognize other modifications, variations and alternatives. For example, it should be apparent that any equipment subject to theft, such as a portable computer, a desktop computer, printer, scanner, or keyboard or the like, may be provided with a security slot for use with the present invention. Furthermore, security slots may be found in any portable equipment, such as skis, bikes, stereo equipment, etc.

Security slot 19 is shown as rectangular. As will be discussed below, several alternative embodiments dictate that the shape of security slot 19 should have a length longer than its width. However, in the preferred embodiment and variants thereof, the security slot 19 may be any suitable shape and size. For example, the slot may be square, rounded, or even circular, and its size need only accommodate hooked tangs 7 or similar locking elements. Therefore, the slot shown for illustration purposes in FIG. 2 should not limit the scope of the claims herein.

When the tang of each insert plate 1 is properly inserted into a security slot 19, the hooked portion of each tang will bear against the inside surface of the equipment shell 17 around the slot 19. Placing the saddle 3 over the insert plates 1 juxtaposes the plates in a back-to-back configuration, with the tang hook portions pointed outwardly as shown in FIG. 1. This produces an even grip on the inside surface of the equipment shell 17.

As shown in FIG. 1, the saddle 3 is sized to fit over the insert plates 1 and hold them together. Saddle 3 may also fit over insert plates 1 in a loose manner, or more tightly. Both the tab of the insert plates 1 and the flaps of the saddle 3 may include a portion of their surfaces defining an aperture to accommodate an object such as a cable or padlock. The use of a cable is illustrated in FIG. 3 which is a partial view of a computer accessory equipment 13, showing a portion of a cable 21 passed through the fastening device saddle 3 and insert plates 1.

Figure 3:
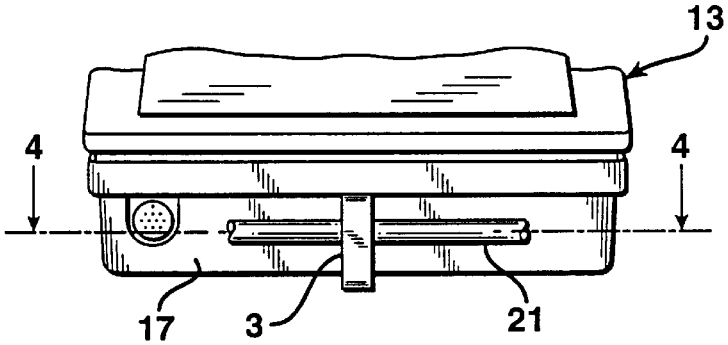
FIG. 3 is a partial rear view of an equipment, showing the invention fastening device installed in a security slot and a cable attached passing through the fastening device.
Figure 4:
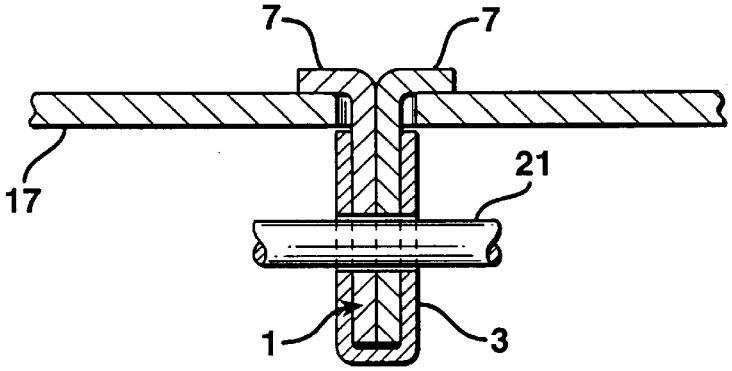
FIG. 4 is a sectional, partial top view of the rear shell of an equipment taken along line 4—4 of FIG. 3, particularly showing the first embodiment installed in a security slot with a cable attachment.

Refer now to FIG. 4 which is a partial cross-section view of an equipment shell 17 and the fastening device of the preferred embodiment inserted in a security slot taken along line 4—4 of FIG. 3. As can be seen, the tangs 7 of the insert plates 1 are inserted through the security slot in the equipment shell 17, with the hooked parts of the tangs 7 extending oppositely.

The underside of the bent part of the tang 7 now bears against the inside surface of the equipment shell 17, and is held in that position by the saddle 3. The saddle's bottom edge is pushed up against or near the outside surface of the shell 17. Thus, the device insert plates 1 are held tightly in a security slot and cannot accidentally loosen.

Placing a cable 21 or a padlock arm through an attachment mechanism in the fastening device adds one more level of securing the fastening device to the equipment outer shell. The cable 21 or padlock insertion makes it virtually impossible to remove or loosen the device from its fastened or locked position. To loosen the device, the insert plates 1 can be carefully separated and removed from the security slot only after first removing the saddle 3.

Figure 5:
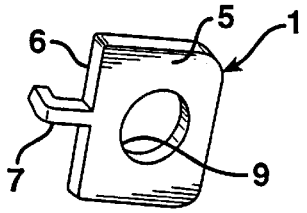
FIG. 5 is a perspective view of one insert plate.
Figure 6:
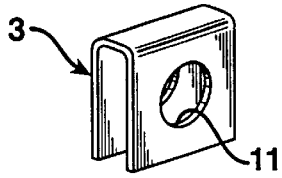
FIG. 6 is a perspective view of a saddle which fits over two insert plates.

Refer now to FIGS. 5 and 6 which show detail of an insert plate 1 and a saddle 3, respectively. Each insert plate 1 may be made of metal or any rigid material that resists bending or breaking. Insert plate 1 is formed in two basic portions, a tab 2 and tang 7. The tab 2 has a mating surface 5 for mating to or adjoining a second insert plate 1. In the preferred embodiment, the tab defines a substantially flat planar surface. In alternative embodiments, however, the tab may be non-planar or having breadth, such as cylindrical or cubical. One edge of the planar surface of tab 2 is a substantially straight tang attachment edge 6 to which the tang 7 is coupled. The tab 2 also includes an attachment mechanism 14 by which two insert plates 1 are held together.

The other portion of insert plate 1 is a hooked tang 7. Tang 7 has an attachment end 8 where it is attached to the attachment edge 6 of tab 2, creating on either side of attachment end 8 a slot entry stop 12. The slot entry stop 12 prevents any part of the tab 2 from being inserted into the security slot. Tang 7 extends outwardly from tang attachment edge 6 in the same plane defined by tab 2. Tang 7 bends at substantially 90 degrees at bend 9, from which distal end 10 extends. The distance from attachment end 8 to bend 9 may be substantially equal to the estimated depth of equipment shell 17, as shown in FIG. 4. When the insert plate is inserted into the slot, distal end 10 bears against the inside surface of shell 17. Distal end 10 extends from bend 9 at approximately 90 degrees from the plane of tab 2.

The thickness of each insert plate 1 may be approximately half or slightly less, than the largest dimension of a security slot to ensure that two of the insert plate tangs 7 can fit in the security slot at the same time.

Referring now to FIG. 6, a saddle 3 is shown. The saddle 3 is sized to slidably cover one or two insert plates 1. The saddle 3 made of a single sheet of material, folded to form a "U" with two parallel flaps 30 of substantially equal length. The size of flaps 30 may also substantially correspond to the planar area of insert plate 1. The width of the space between the two flaps 30 should preferably be about twice the thickness of each insert plate 1 plus clearance if two insert plates 1 are to be covered.

The flaps 30 also contain an attachment mechanism 11 for securing the saddle 3 over the insert plate or plates 1. In the preferred embodiment, attachment mechanism 11 is a portion of the flaps defining an aperture having dimensions and placement corresponding with an aperture 14 defined by insert plate 1. Aligning the apertures 11 with aperture(s) 14 allows insertion of a cable or a padlock arm through the assembled device. In alternative embodiments, the size and shape of the apertures may depend on a specific cable or locking apparatus.

Figure 7:
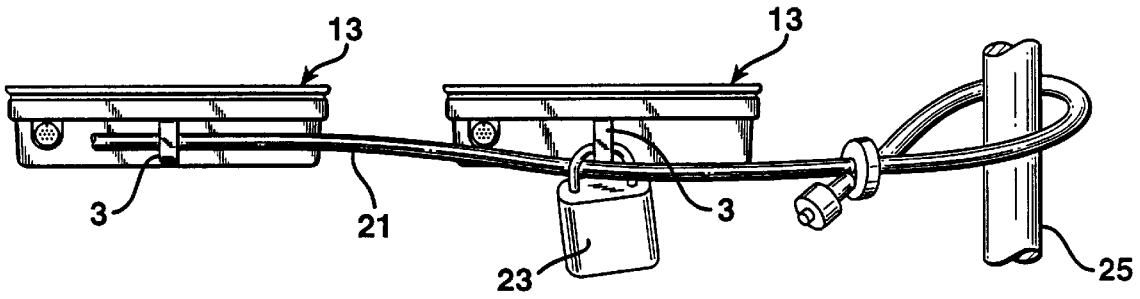
FIG. 7 is a view illustrating two or more equipments with security slots locked to a cable by the present invention.

Illustrated in FIG. 7 is one accepted application where the device of the present invention may be used together with a security slot in equipment to secure the equipment against theft. In the illustration, a computer accessory equipment 13 is secured to a cable 21 by having the cable 21 pass directly through an aperture in the saddle 3 when the insert plates have had their tangs inserted in its security slot. This approach could be used where the several different equipments of a system are being secured together on one cable as would be the case in an office. The other equipment 13 has a padlock 23 arm going through the slots in its attached fastening device and the cable 21 passing through the padlock 23. This approach may be used wherever several equipments are located, yet desirable to be able to unlock and remove any one of the equipments separately.

As an example of how the equipment may be secured by a cable 21, the cable is shown having one end passed through a collar, looped around an immovable pole 25 with its end passing back through the collar and a clamp is locked on the end. The other end of the cable (not shown) would have a similar locked clamp attached to prevent pull through.

Figure 8A:
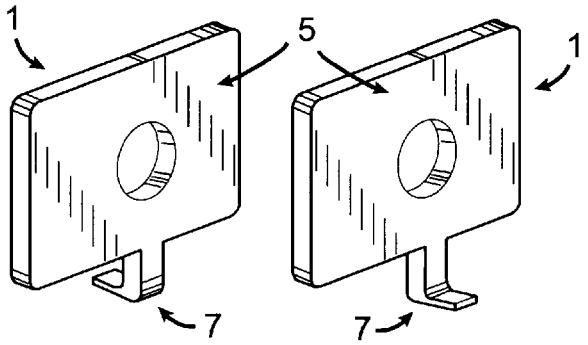
FIG. 8A is a perspective view of two insert plates.
Figure 8B:
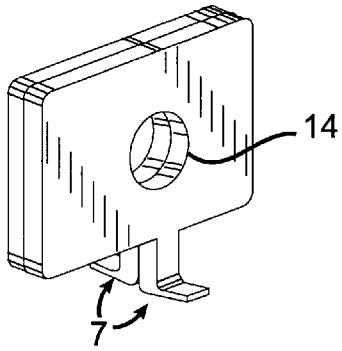
FIG. 8B is a perspective view of a second embodiment of an assembled fastening device.

An alternative specific embodiment of the present invention is shown in FIGS. 8A and 8B. In an even simpler design, a locking device is shown having only two insert plates 1, discussed above in detail with reference to FIG. 5. In operation, the hook ends of tang 7 of each insert plate 1 are individually inserted into a security slot, then the mating surfaces 5 of tabs 2 are placed together, illustrated in FIG. 8B. In this position the two insert plates 1 create a locking interface between an equipment 13 and any object other than equipment 13 by way of attachment mechanisms 14 in each plate 1.

Figure 9A:
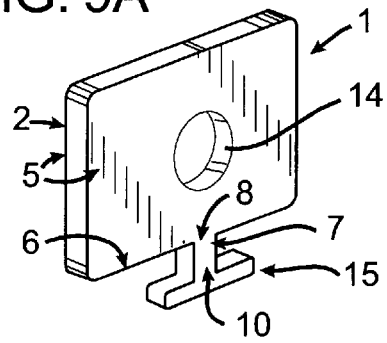
FIG. 9A is a perspective view of a third embodiment of an insert plate.
Figure 9B:
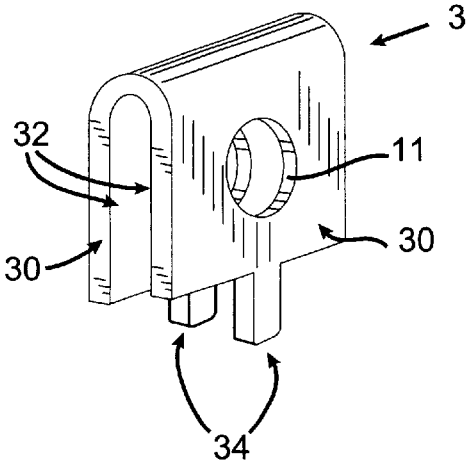
FIG. 9B is a perspective view of a saddle which fits over the insert plate of FIG. 9A.
Figure 9C:
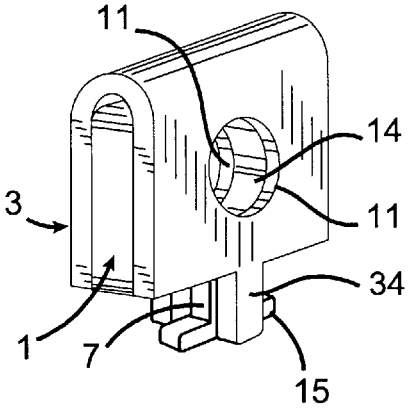
FIG. 9C is a perspective view of a third embodiment of an assembled fastening device.

Illustrated in FIGS. 9A, 9B and 9C is a third embodiment of a fastening device according to the present invention. FIG. 9A is a perspective view of an insert plate 1 according to the third embodiment. Insert plate 1 in FIG. 9A has two basic portions, a tab 2 and a tang 7, substantially the same as, and described with reference to, the insert plate shown in FIG. 5. Attached to the distal end 10 of tang 7 is a locking member 15, which may be located within the same plane as that defined by the tab 2. The locking member 15, tab 2 and the tang 7 may all be constructed from a single piece of material.

Locking member 15 is sized to be slightly smaller than the security slot in which it is to be inserted. In this embodiment, the security slot has a length that is longer than its width. In operation, locking member 15 is inserted into a security slot in its unlocked mode, and the tang attachment end 6 prevents any of the tab 2 from being inserted into the slot. The locking mechanism 15 is next transitioned to locking mode by rotating or otherwise engaging to the inside surface of an equipment shell.

FIG. 9B is a perspective view of a saddle 3 adapted to fit over the insert plate of FIG. 9A. The saddle 3 is similar to the saddle illustrated in FIG. 6 and discussed in detail above. Extending from a substantially straight edge of the flaps 30 may be one or more pins 34. In the preferred embodiment, one pin 34 extends from the approximate center of the lower edge of each flap 30. Each flap 30 has an inside mating surface 32 which couples the front and back sides of the insert plate 1. Flaps 30 preferably are sized to correspond to the plate 1 in width and height.

FIG. 9C is a perspective view of an assembled fastening device according to the third embodiment of the present invention. The saddle 3 comfortably slides over insert plate 1. The pins 34 are positioned adjacent the tang 7 and may extend to the lower side of the locking member 15. When the locking member 15 is transitioned to its locking mode, the pins 34 may be inserted into the slot adjacent the locking member 15 to prevent its transition back to an unlocked mode.

Figure 10A:
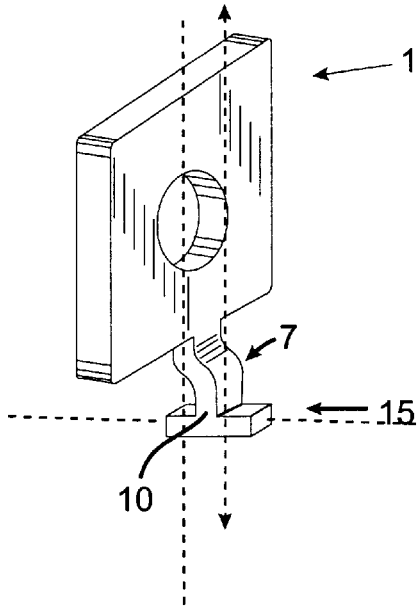
FIG. 10A is a perspective view of a fourth embodiment of an insert plate.
Figure 10B:
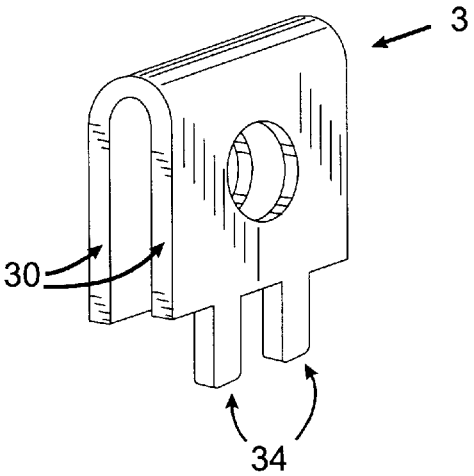
FIG. 10B is a perspective view of a saddle which fits over the insert plate of FIG. 10A.
Figure 10C:
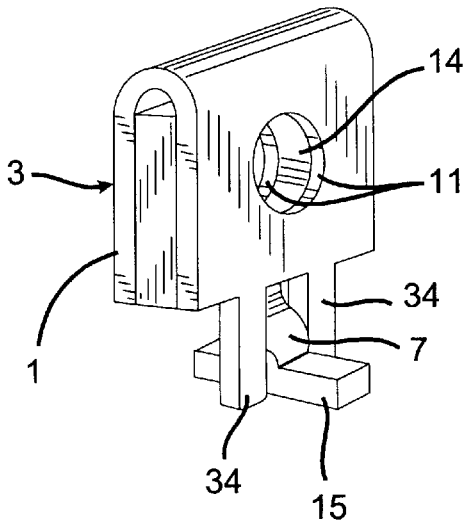
FIG. 10C is a perspective view of a fourth embodiment of an assembled fastening device.

FIGS. 10A, 10B, and 10C illustrate a fourth embodiment of a fastening device of the present invention. In the embodiment shown in FIG. 10A, the locking member 15 is orthogonal to the plane defined by tab 2 of insert plate 1. The tang 7 may be shifted away from the plane of tab 2, or may extend within the plane. To accommodate the locking member 15 of FIG. 10A, the pins 34 of saddle 3 both extend from one flap 30. An alternate to this specific embodiment may have only one pin extending from either flap 3.

As shown in FIG. 10C, the pins 34 extend down on either side of tang 7 and near the midpoint of the locking mechanism 15. The embodiment shown in FIG. 10C operates similarly to that described with reference to FIG. 9C. By inserting a cable or lock into the attachment mechanisms 11 and 14, aligned in the locking mode, the device may neither be pulled apart nor unfastened from the equipment shell.

FIGS. 11A and 11B illustrate an operation of the locking member in the third and fourth embodiments discussed above. In FIG. 11A, there is shown a security slot 19 defined in an equipment shell 17. Locking member 15 is adapted to be complementary in size and shape to the slot 19, with clearances for easy insertion and removal.

As shown in FIG. 11B, the locking member 15 is transitioned to be transverse to the shape of the slot 19, where the top surfaces of the locking member 15 engage the inside surface of the shell 17. To secure the locking member 15 in its locked mode, pins 34 extending from the saddle (not shown) are inserted adjacent to the locking member 34. The combination of the mid-portion of the locking member 15 and the pins 34 may form a shape complementary to the slot 19. Once locked in place, the locking member 15 may not be removed or pulled out of the slot 19.

While the above is a full description of the specific embodiments, various modifications, alternative constructions and equivalents may be used. Therefore, the above description and illustrations should not be taken as limiting the scope of the present invention which is defined by the appended claims.

What is claimed is:

1. A device for fastening to equipment subject to theft and including a security slot in an equipment shell, said device comprising:

two insert plates, each said insert plate comprising:

a tab having a mating surface and a tang attachment edge; and a hooked tang having a distal end, a tang attachment end, and a bend therebetween, said tang attachment end coupled to and projecting from said tang attachment edge, said hooked tang adapted for insertion into the security slot such that said distal end bears against an inside surface of the shell;

wherein juxtaposition of said mating surfaces of said insert plates in a locking mode provides for said distal ends to extend oppositely; and wherein said tabs include an attachment mechanism to maintain said plates in said locking mode when said distal ends are each inserted into the security slot.

2. The device of claim 1 further comprising a saddle sized to fit over the tabs of said insert plates, and wherein association of said saddle over said mating surfaces of said insert plates maintains said plates in said juxtaposition.

3. A device for fastening to equipment subject to theft and including a security slot in an equipment shell, said device comprising:

two insert plates, each said insert plate comprising:

a tab having a mating surface and a tang attachment edge wherein said tab defines a first plane; and a hooked tang having a distal end, a tang attachment end, and a substantially right-angle bend therebetween, said tang attachment end coupled to and projecting, in said first plane, from said tang attachment edge with said hooked tang forming a slot entry stop proximate to said tang attachment end on said tang attachment edge, said distal end projecting in a second plane approximately orthogonal to said first plane, with each said hooked tang adapted for insertion into the security slot such that said distal end bears against an inside surface of the shell and said slot entry stop bears against an outer surface of the shell;

wherein juxtaposition of said mating surfaces of said insert plates in a locking mode provides for said distal ends to extend oppositely; and wherein said tabs include an attachment mechanism to maintain said plates in said locking mode when said distal ends are each inserted into the security slot.

4. The device of claim 3 wherein said mating surfaces are planar.

5. The device of claim 3 wherein said mating surfaces are complementary to each other.

6. The device of claim 3 wherein said attachment mechanism comprises a portion of each said tab defining an aperture and wherein an object extends through each said aperture.

7. A device for fastening to equipment subject to theft and including a security slot in an equipment shell, said device comprising:

two insert plates, each said insert plate comprising:

a tab having a mating surface and a tang attachment edge wherein said tab defines a first plane; and a hooked tang having a distal end, a tang attachment end, and a substantially right-angle bend therebetween, said tang attachment end coupled to and projecting, in said first plane, from said tang attachment edge with said hooked tang forming a slot entry stop proximate to said tang attachment end on said tang attachment edge, said distal end projecting in a second plane approximately orthogonal to said first plane, with each said hooked tang adapted for insertion into the security slot such that said distal end bears against an inside surface of the shell and said slot entry stop bears against an outer surface of the shell; and a saddle having two mating surfaces, said saddle sized to fit over the tabs of said insert plates;

wherein juxtaposition of said mating surfaces of said insert plates in a locking mode provides for said distal ends to extend oppositely;

wherein association of said saddle over said mating surfaces of said insert plates maintains said plates in said juxtaposition; and wherein said tabs and said saddle include an attachment mechanism to maintain said plates in said locking mode when said distal ends are each inserted into the security slot.

8. The device of claim 7 wherein said saddle mating surfaces and said tab mating surfaces are planar.

9. The device of claim 7 wherein said tab mating surfaces are complementary to each other.

10. The device of claim 9 wherein said saddle mating surfaces are complementary to said tab mating surfaces.

11. The device of claim 7 wherein said attachment mechanism comprises a portion of each mating surface defining an aperture and wherein an object extends through each said aperture.

12. A method of fastening a device to equipment subject to theft and provided with a security slot in an equipment shell, wherein said device comprises at least one insert plate having a security slot locking member, and a saddle having two flaps complementary to said insert plate and a bridge coupling said flaps such that the bridge and the flaps define a U-shape, said plate and said flaps having an aperture, said method comprising:

inserting said locking member into the security slot;

transitioning said locking member into a locking mode wherein said locking member engages an inside surface of said shell;

straddling said U-shaped saddle over said insert plate so that an inside surface of each flap juxtaposes an opposite side of said plate to thereby secure said device to said equipment.

13. The method of claim 12 further comprising:

aligning the aperture of said flaps with the aperture of said plate; and passing a security cable or padlock therethrough to secure said saddle to said insert plate.

14. A method of fastening a device to equipment subject to theft and provided with a security slot in an equipment shell, wherein said device comprises two insert plates each having a tab and a hooked tang, said tab having a mating surface and an aperture, said method comprising:

inserting said tangs into the security slot;

engaging a distal end of said tangs to an inside surface of said shell;

associating said mating surfaces of said tabs; and passing a security cable or padlock through said apertures of each said tab.

15. A device for fastening to equipment subject to theft and including a security slot in an equipment shell, said device comprising:

an insert plate comprising:

a tab defining a first plane and having a tang attachment edge;

a tang having a distal end and a tang attachment end, said tang attachment end coupled to and projecting, in said first plane, from said tang attachment edge with said tang forming a slot entry stop proximate to said tang attachment end on said tang attachment edge; and a locking member coupled to said distal end of said tang and having a peripheral profile complementary to dimensions of said security slot, said locking member adapted for insertion into and withdrawal from said slot when in said unlocked mode and for engagement with an inside surface of the shell when in said locked mode; and a saddle sized to fit over said tab comprising:

two flaps, each flap having a mating surface and a pin attachment edge;

a bridging portion coupled to each of the two flaps, the bridging portion and the two flaps adapted to define a substantially U-shape; and at least one pin coupled to and projecting, in a second plane parallel to said first plane, from one said pin attachment edge, said pin adapted for insertion into the security slot adjacent said locking member when in said locked mode;

wherein insertion of said locking member into said slot and transition of said locking member from said unlocked mode to said locked mode engages said locking member to said inside surface of the shell; and wherein association of said saddle over said tab engages said mating surfaces of said flaps to opposite sides of said tab, and insertion of said pin into the security slot inhibits transition of said locking member to said unlocked mode; and wherein said tab and said saddle include an attachment mechanism to maintain the association of said saddle to said tab, the attachment mechanism comprising a portion of said tab and said flaps defining an aperture and wherein an object extends through each said aperture.

16. A device for fastening to equipment subject to theft and including a security slot in an equipment shell, said device comprising:

an insert plate comprising:

a tab defining a first plane and having a tang attachment edge;

a tang having a distal end and a tang attachment end, said tang attachment end coupled to and projecting, in said first plane, from said tang attachment edge with said tang forming a slot entry stop proximate to said tang attachment end on said tang attachment edge; and a locking member coupled to said distal end of said tang and having a peripheral profile complementary to dimensions of said security slot, said locking member orthogonal to said first plane and adapted for insertion into and withdrawal from said slot when in said unlocked mode and for engagement with an inside surface of the shell when in said locked mode; and a saddle sized to fit over said tab comprising:

two flaps, each flap having a mating surface and a pin attachment edge;

a bridging portion coupled to each of the two flaps, the bridging portion and the two flaps adapted to define a substantially U-shape; and at least one pin coupled to and projecting, in a second plane parallel to said first plane, from one said pin attachment edge, said pin adapted for insertion into the security slot adjacent said locking member when in said locked mode;

wherein insertion of said locking member into said slot and transition of said locking member from said unlocked mode to said locked mode engages said locking member to said inside surface of the shell; and wherein association of said saddle over said tab engages said mating surfaces of said flaps to opposite sides of said tab, and insertion of said pin into the security slot inhibits transition of said locking member to said unlocked mode; and wherein said tab and said saddle include an attachment mechanism to maintain the association of said saddle to said tab.

17. A device for fastening to equipment subject to theft and including a security slot in an equipment shell, said device comprising:

an insert plate comprising:

a tab defining a first plane and having a tang attachment edge;

a tang having a distal end and a tang attachment end, said tang attachment end coupled to and projecting, in said first plane, from said tang attachment edge with said tang forming a slot entry stop proximate to said tang attachment end on said tang attachment edge; and a locking member coupled to said distal end of said tang and having a peripheral profile complementary to dimensions of said security slot, said locking member adapted for insertion into and withdrawal from said slot when in said unlocked mode and for engagement with an inside surface of the shell when in said locked mode; and a saddle sized to fit over said tab comprising:

two flaps, each flap having a mating surface and a pin attachment edge;

a bridging portion coupled to each of the two flaps, the bridging portion and the two flaps adapted to define a substantially U-shape; and two pins coupled to and projecting, in a second plane parallel to said first plane, from said pin attachment edge of one of said two parallel flaps, said pins adapted for insertion into the security slot adjacent said locking member when in said locked mode;

wherein insertion of said locking member into said slot and transition of said locking member from said unlocked mode to said locked mode engages said locking member to said inside surface of the shell; and wherein association of said saddle over said tab engages said mating surfaces of said flaps to opposite sides of said tab, and insertion of said pin into the security slot inhibits transition of said locking member to said unlocked mode; and wherein said tab and said saddle include an attachment mechanism to maintain the association of said saddle to said tab.

18. A device for fastening to equipment subject to theft and including a security slot in an equipment shell, said device comprising:

an insert plate comprising:

a tab defining a first plane and having a tang attachment edge;

a tang having a distal end and a tang attachment end, said tang attachment end coupled to and projecting, in said first plane, from said tang attachment edge with said tang forming a slot entry stop proximate to said tang attachment end on said tang attachment edge, and said distal end curved out from said first plane to a second plane parallel to said first plane; and a locking member coupled to said distal end of said tang and having a peripheral profile complementary to dimensions of said security slot, said locking member adapted for insertion into and withdrawal from said slot when in said unlocked mode and for engagement with an inside surface of the shell when in said locked mode; and a saddle sized to fit over said tab comprising:

two flaps, each flap having a mating surface and a pin attachment edge;

a bridging portion coupled to each of the two flaps, the bridging portion and the two flaps adapted to define a substantially U-shape; and at least one pin coupled to and projecting, in the second plane, from one said pin attachment edge, said pin adapted for insertion into the security slot adjacent said locking member when in said locked mode;

wherein insertion of said locking member into said slot and transition of said locking member from said unlocked mode to said locked mode engages said locking member to said inside surface of the shell; and wherein association of said saddle over said tab engages said mating surfaces of said flaps to opposite sides of said tab, and insertion of said pin into the security slot inhibits transition of said locking member to said unlocked mode; and wherein said tab and said saddle include an attachment mechanism to maintain the association of said saddle to said tab.

* * * * *